United States Patent [19]

Kojima

[11] 4,055,249

[45] Oct. 25, 1977

[54] STICKER PACKAGE

[76] Inventor: Shirou Kojima, 14-3, 1-chome, Nishishinjuku, Shinjuku, Tokyo, Japan

[21] Appl. No.: 342,362

[22] Filed: Mar. 19, 1973

[30] Foreign Application Priority Data

Mar. 17, 1972 Japan ..... 47-27132

[51] Int. Cl.[2] ..... B65D 85/70

[52] U.S. Cl. ..... 206/447; 206/390; 206/460; 206/820; 428/42

[58] Field of Search ..... 206/447, 390, 820, 460, 206/411; 161/38, 39, 40, 36; 428/40, 41, 42

[56] References Cited

U.S. PATENT DOCUMENTS

| | | | |
|---|---|---|---|
| 2,679,928 | 6/1954 | Bishop, Jr. et al. | 206/447 |
| 3,383,121 | 5/1968 | Singer | 161/38 X |
| 3,501,365 | 3/1970 | Marshall | 161/38 |

FOREIGN PATENT DOCUMENTS

| | | | |
|---|---|---|---|
| 589,611 | 6/1947 | United Kingdom | 206/447 |

*Primary Examiner*—George E. Lowrance
*Assistant Examiner*—Joseph Man-Fu Moy
*Attorney, Agent, or Firm*—Robert E. Burns; Emmanuel J. Lobato; Bruce L. Adams

[57] ABSTRACT

Sticker having an elongated lug outside of a sticking sheet which is formed by a part of a release sheet.

In this sticker, a surface of adhesive supported by said sticking sheet is covered by a releasable sheet, which is provided with parting lines extending from a portion under the release sheet to a portion outside of said sheet for forming said lug.

Said lug may be used for picking a portion with the fingers when the sticking sheet is stripped off.

Said sticker is made in such a manner that parting lines for forming sticking sheets and lugs respectively are made by means of cutting dies provided on opposite sides of material which is held between said dies.

4 Claims, 16 Drawing Figures

STICKER PACKAGE

BACKGROUND OF THE INVENTION

This invention relates to a sticker such as a sealing paper having releasable protection paper stuck on a surface of adhesive.

Adhesive goods temporarily attached with a releasable sheet on the adhesive surface of a sheet material covered with pressure sensitive adhesive are known. The releasable sheet temporarily attached on these goods is not utilized for any purpose other than the protection of the tacky adhesive layer, but is thrown away after it is released from the adhesive surface as good-for-nothing.

On the other hand, there is a known sealing paper having an adhesive layer for sealing the openings of envelopes, packages and the like, however, the sealing paper stuck thereon is difficult to be stripped off and troublesome to take off the seal. To eliminate such trouble, goods have been made wherein a thread or a string for tearing off the sealing paper is inserted and stuck on the adhesive surface of said sealing paper, which is to be torn off by pulling said thread or string in case the seal is taken off. But, to insert such a thread or string is not only time-consuming and troublesome but also expensive as excessive materials are required.

SUMMARY OF THE INVENTION

It is an object of the invention to provide novel sticker capable of utilizing a part of a releasable sheet which has been so far thrown away in vain after its use for the protection of the surface of a pressure sensitive adhesive.

Another object of the invention is to provide a sealing substance capable of easy breaking of a sealed portion without impairing the sealing function or the opening of sealed matter, by utilizing a part of the said release sheet as mentioned above.

The stickers according to the present invention are provided with parting lines capable of forming lugs of suitable shape for releasing a sheet from the pressure sensitive adhesive. And, when the sticking sheet is stripped off from the release sheet, a part of said release sheet remains on the adhesive surface of said sticking sheet as a lug.

Other objects and advantages will appear from the following description of an example of the invention, and the novel features will be particularly pointed out in the appended claims.

DESCRIPTION OF THE PREFERRED EMBODIMENTS

Figure 1:
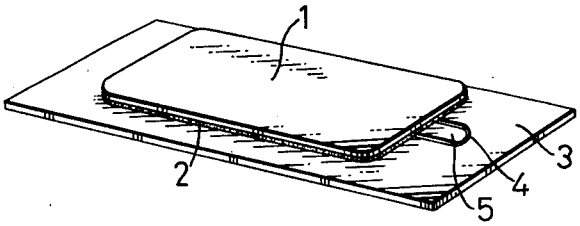
FIG. 1 is a perspective view of a sticker according to the present invention.
Figure 2:
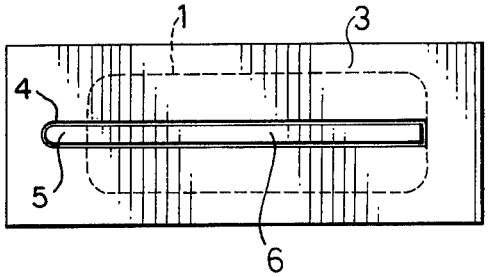
FIG. 2 is a bottom view of FIG. 1.
Figure 3:
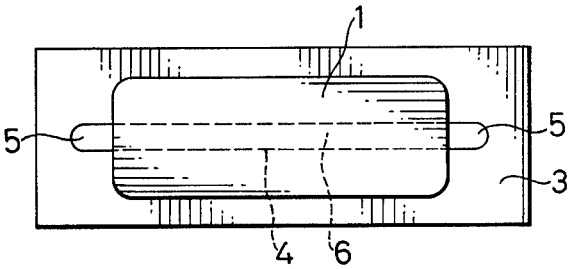
FIG. 3 is a plan view, showing a variant of the sticker according to the present invention.

In FIG. 1 and FIG. 2, a sticker showing a fundamental concept of the present invention is shown. The sticker comprises a flexible sticking sheet 1, a layer 2 of adhesives thereon, and, stuck on the surface of the adhesives, a releasable sheet 3. On the releasable sheet 3, there is provided, substantially below the sticking sheet 1, a parting line 4 forming and defining a relatively narrow, strip-like portion 6 of the releasable sheet, which portion has an end 5 (FIGS. 1, 2), or two ends 5 (FIG. 3). Each of these ends provides a lug 5 which extends to the outside of sheet 1.

Figure 15:
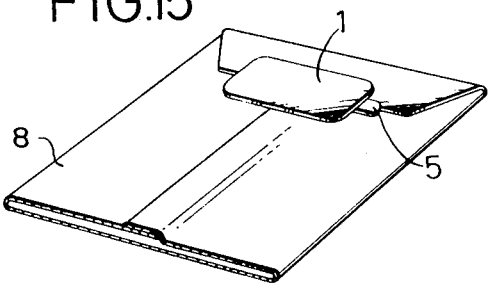
FIG. 15 is a partially cutaway perspective view, showing an example of the sticker according to the present invention attached to an envelope.

When the sticker is used for a seal or the like, the sticking sheet 1 thereof is stripped off from the releasable sheet 3, then its adhesive layer 2 is exposed, while said lug 5 is separated at the parting line 4 together with said strip-like portion 6 and said sticking sheet from the side of the releasable sheet, (also see FIG. 4), so that said sticking sheet may then be stuck on the opening of an envelope or the like 8 to effect sealing (FIG. 15). In this case, since the strip 6 can be kept adherent to sticking sheet 1 and an end portion or lug 5 of the strip 6 is in a free state extending outside of the stuck sheet, the lug, strip and sheet may be pulled up by picking it up with the fingers to strip off the sticking sheet for opening the envelope. The strip portion 6 of the lug 5, extending under the sticking sheet 1 will facilitate the breaking or stripping of the envelope when it is opened. The portion 6 of said lug 5 extending under the sticking sheet may produce similar effect when it is formed shorter than shown; on the other hand as shown in FIG. 3, both ends of lug 5 may extend outside from the edge portions of the sticking sheet 1.

Said sticker may be formed in such manners that plural sticking sheets are arranged on a release sheet with or without intervals, adjoining each other in parallel, in series or in series-parallel.

Figure 4:
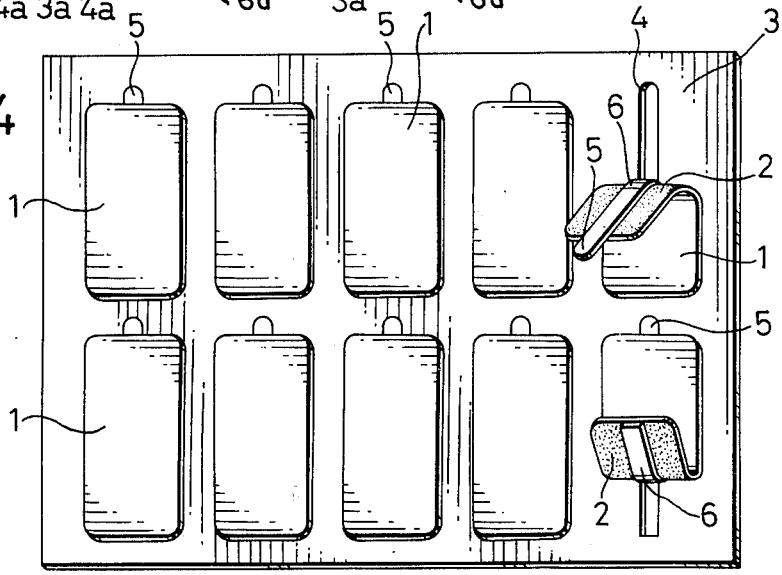
FIG. 4 shows a second variant of the sticker according to the present invention and is a perspective view, generally in plan view, showing a unit whereon a plurality of sticking sheets are arranged on a releasable sheet and only some of them are taken off.

In FIG. 4, a plurality of said sticking sheets 1 are arranged on a release sheet with intervals in lengthwise and crosswise directions, showing stickers with parting lines 4 for forming lugs 5 similar to the above on said release sheet 3.

Figure 5:
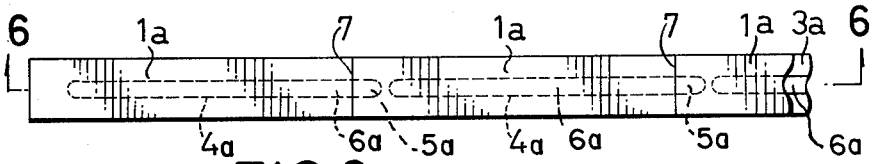
FIG. 5 is a plan view of a third variant of the sticker according to the present invention and is a plan of a portion of a unit wherein a plurality of sticking sheets are arranged on a releasable sheet or ribbon.
Figure 6:
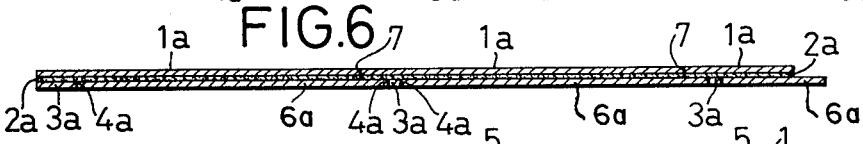
FIG. 6 is a cross section taken on line 6—6 in FIG. 5.

In FIG. 5 and FIG. 6, there are shown a plurality of sticking sheets **1*a* arranged on a release sheet adjoining each other with parting lines 7 therebetween. Parting lines 4*a* for each strip 6*a* having lug 5*a* provided in a release sheet 3*a* of the sticker, are extended over an under portion of each sticking sheet 1*a* and an under portion of another sticking sheet 1a adjoining the former. As already noted, when a sticking sheet 1a is stripped off from the release sheet 3a, the strip-like part 6a with lug 5a remains on the adhesive surface 2a; thereby facilitating the stripping off operation itself and also facilitating any desired, ultimate lifting off of the sticker 1a** from a surface to which it has been applied.

Figure 7:
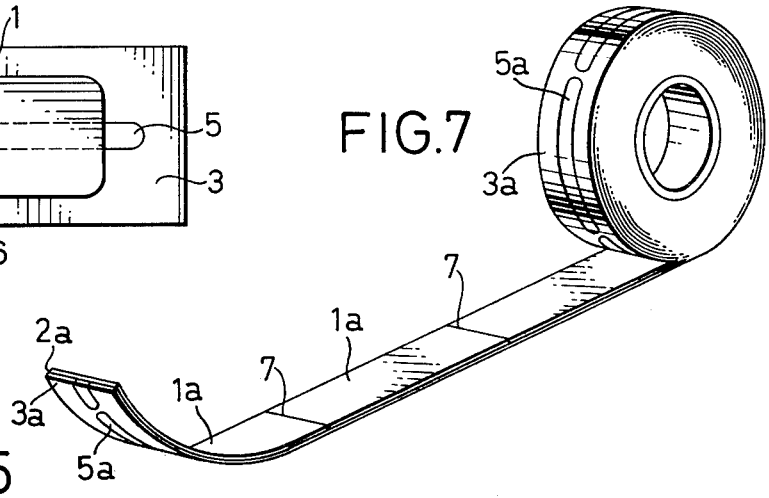
FIG. 7 is a perspective view, showing a rolled up state of the sticker of FIG. 5.

Such stickers 1a of continuous shape may be used for many sealing operations, by stripping off the sticking sheets successively from their release sheet 3a. Said sticker may be disposed for an efficient sealing operation by winding it to form a roll or cylinder (FIG. 7) and loading it on a sealing machine (not shown).

Figure 8:
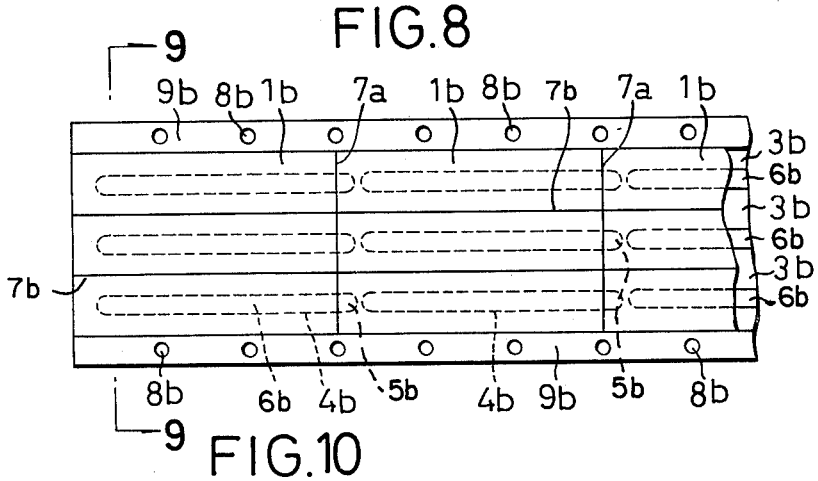
FIG. 8 is a fourth variant of the sticker according to the present invention and is a partial plan view showing a unit wherein a plurality of sticking sheets are arranged on a release sheet adjoining each other bordered by parting lines.
Figure 9:
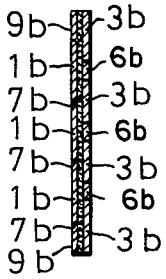
FIG. 9 is a cross section taken on line 9—9 in FIG. 8, FIG. 10 to FIG. 14 inclusive are other variants of the sticker according to the present invention and are plans showing stickers having parting lines for forming lugs of different shapes respectively.

Still another example or variant is shown in FIG. 8 and FIG. 9.

This example is different in the point that a plurality of sticking sheets 1b are lengthwise and crosswise arranged in parallel bordered by parting lines 7a and 7b and in some points that will be explained hereafter. Otherwise it is about the same as the example shown in FIG. 5 and FIG. 6. And, in this example, each partition line 7b extending in axial direction may pass through the transverse parting lines 7a between the sheets 1b. The arrangement of lug ends 5b of strip portions 6b in the releasable sheet 3b corresponds to the arrangement of ends 5a in releasable sheet 3a of FIG. 5.

Holes 8b provided on side edge portion 9b of the base material on the outside of said sticking sheet may be utilized for feeding of the base material, in color printing, automatic control of working process by means of computer, etc.

The portion 9b around the sticking sheet will be removed after required working process is finished, however, it may be left behind if necessary.

Figure 10:
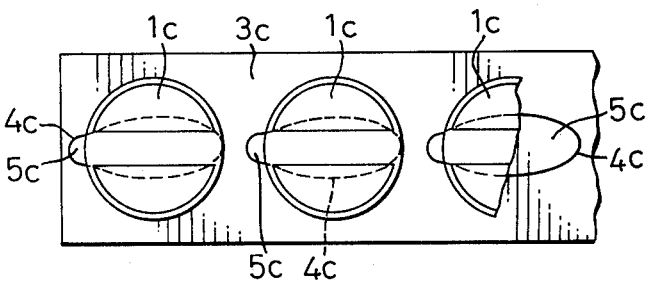
Figure 14:
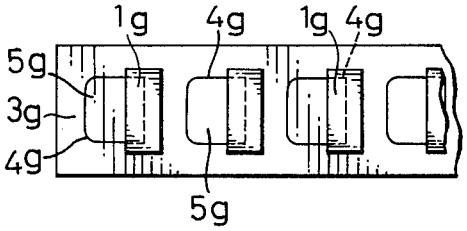
Figure 11:
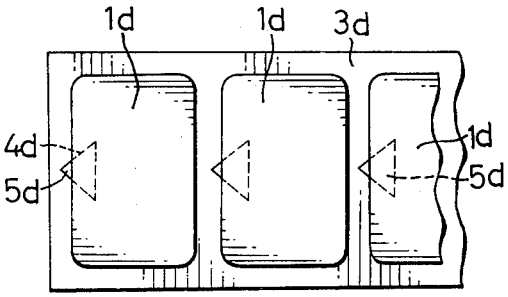
Figure 12:
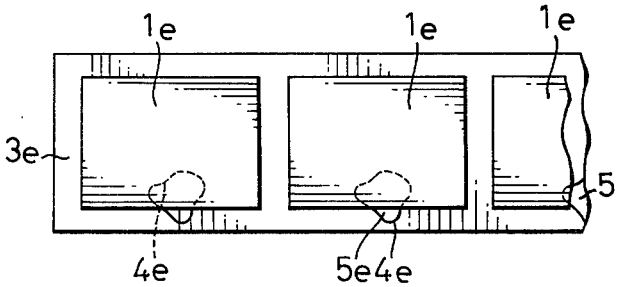
Figure 13:
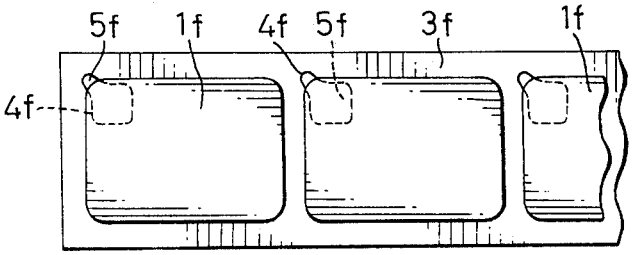

Simple variants as will be mentioned hereafter may be made according to the present invention. They include; release sheet 3c of a circular sticking sheet 1c having a parting line 4c for forming an elliptical lug 5c (FIG. 10), release sheets 3d of sticking sheet 1d having parting lines 4d for forming triangle lugs 5d (FIG. 11), release sheets 3e of sticking sheet 1e having parting lines 4e for forming irregular shaped lug 5e (FIG. 12), release sheet 3f having parting lines 4f for forming lugs 5f on corner portions of sticking sheets 1f (FIG. 13), and release sheet 3g of sticking sheet 1g having parting line 4g for forming lug 5g of relatively large shape (FIG. 14).

Figure 16:
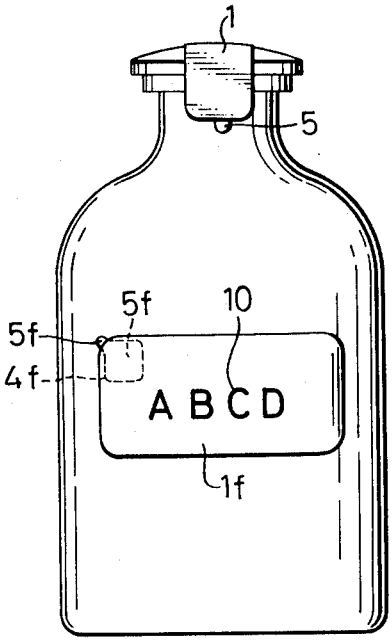
FIG. 16 is a perspective view, showing an example of the sticker according to the present invention attached to a bottle.

Each of above mentioned stickers according to the present invention may be temporarily stuck on the surface of any body, for which its lug will serve, and be stripped off later. For instance, the sticker may be used for indication 10 of the contents by sticking it temporarily on a bottle as shown in FIG. 16.

And, the sticker may be used as a substitute for paste, with which notice papers such as posters and the like are stuck on walls, notice boards, telegraph poles, etc., or may be used as a substitute for a thumbtack when works of pupils and students, such as drawings, materials for lecture, etc., are put up on a black board or wall in a school or lecture hall.

The sticker according to the present invention may be manufactured as follows. The material for sticking sheets made of paper to be used for sealing paper is coated with adhesive liquid having a composition as exemplified below to form pressure sensitive adhesive layer, on which the material for a release sheet having releasability against said pressure sensitive adhesive is put in layers to prepare the base material.

| Examples for Compounding ratio of Pressure Sensitive Adhesive: | | | | |
|---|---|---|---|---|
| (A) | Polyisobutylene (molecular weight 52,000) | 100 | weight | part |
| | Hydrogenated coumarone-indene | 40 | " | " |
| | Methyl acetate | 20 | " | " |
| | Zinc white | 50 | " | " |
| | Heptane | 700 | " | " |
| (B) | Acrylic acid 2-ethyl hexyl polymer | 80 | " | " |
| | Poly vinyl acetate | 15 | " | " |
| | Acrylic acid polymer | 5 | " | " |
| | Ethyl acetate | 75 | " | " |
| | Toluene | 75 | " | " |
| (C) | Styrene-isoprene block copolymer | 60 | " | " |
| | Hydrogenated rosin ester | 40 | " | " |
| | Antioxidant | 0.1 | " | " |
| | n-hexane | 400 | " | " |
| (D) | Pale crepe rubber | 100 | " | " |
| | Poly β pinene resin | 75 | " | " |
| | Petroleum oil | 5 | " | " |
| | Polymerized trimethyl di-hydroquinone | 2 | " | " |
| | Mixed hydrocarbon solvent | 350 | " | " |
| (E) | Styrene-butadiene rubber | 50 | " | " |
| | Smoked rubber | 50 | " | " |
| | Hydrogenated rosin ester | 50 | " | " |
| | Trimethyl hydroquinone | 2 | " | " |
| | Petroleum oil | 20 | " | " |
| | Mixed hydrocarbon solvent | 350 | " | " |

In place of the sticking sheet materials such as the above mentioned papers, synthetic resin sheet, synthetic paper, metal foil, papers and resin sheet having metal foil or metallizing layer, etc., may be used.

While the present invention has been described in its several examples, it is understood that the invention is not limited therein, but changes and variations may be made within the spirit of the invention set forth in the following claims.

What is claimed is:

1. A sticker unit, comprising;

a plurality of sticking sheets disposed as a series in contact with one another longitudinally of the series and having sticker parting lines disposed transversely of the series between the sticking sheets;

a layer of pressure sensitive adhesive on a surface of the series of sticking sheets; and a release sheet temporarily stuck on said layer of adhesive, said release sheet extending along and substantially coextensive with said series of sticking sheets and having parting lines defining release sheet portions, each portion comprising a part underlying a limited part of a respective sticking sheet and a lug at an end of said part, said lug underlying an adjacent sticking sheet;

thereby facilitating stripping successive sticking sheets of said series from the release sheet and also facilitating subsequent stripping of each sticking sheet from any surface whereon it is stuck.

2. A unit according to claim 1 in which each sticking sheet has sides longitudinal of said series and sides transverse thereof, and each of said release sheet portions is a strip longitudinal of the series, narrower than the transversal sides, and spaced from the longitudinal sides.

3. A unit according to claim 1 in which said series of sticking sheets and said release sheet temporarily stuck to the adhesive layer thereon are disposed as a roll for successive unrolling of individual sticking sheets.

4. A unit according to claim 1 in which said sticking sheets are disposed as a plurality of rows parallel with one another and with longitudinal sticker parting lines between the several rows.

* * * * *